US012245678B2

(12) United States Patent
Cutler

(10) Patent No.: US 12,245,678 B2
(45) Date of Patent: Mar. 11, 2025

(54) APPLICATOR FOR APPLYING CREAMS, SERUMS, LOTIONS, LIQUIDS, GELS AND OTHER FLOWABLE MATERIALS

(71) Applicant: Amy Cutler, Draper, UT (US)

(72) Inventor: Amy Cutler, Draper, UT (US)

( * ) Notice: Subject to any disclaimer, the term of this patent is extended or adjusted under 35 U.S.C. 154(b) by 0 days.

(21) Appl. No.: 18/222,388

(22) Filed: Jul. 14, 2023

(65) Prior Publication Data

US 2024/0016279 A1 Jan. 18, 2024

Related U.S. Application Data

(60) Provisional application No. 63/408,804, filed on Sep. 21, 2022, provisional application No. 63/389,772, filed on Jul. 15, 2022.

(51) Int. Cl.

| | |
|---|---|
| ***A46B 11/04*** | (2006.01) |
| ***A45D 34/04*** | (2006.01) |
| ***A46B 11/00*** | (2006.01) |

(52) U.S. Cl.

CPC ..... *A45D 34/04* (2013.01); *A45D 34/042* (2013.01); *A46B 11/0037* (2013.01); *A46B 11/0079* (2013.01); *A46B 11/0086* (2013.01)

(58) Field of Classification Search

CPC ..... A46B 11/0079; A46B 11/0037; A46B 11/0086; A46B 11/0089; A46B 11/0041; A45D 34/042

USPC ..... 401/270

See application file for complete search history.

(56) References Cited

U.S. PATENT DOCUMENTS

| | | | | |
|---|---|---|---|---|
| 6,702,733 | B1 | 3/2004 | Thompson | |
| D512,647 | S | 12/2005 | Py | |
| 7,086,796 | B2 | 8/2006 | Severa | |
| 7,101,107 | B1 * | 9/2006 | Byun | B05B 11/0064 401/187 |
| D558,920 | S | 1/2008 | Sheppard | |
| D567,509 | S | 4/2008 | Kao | |
| 8,016,508 | B2 * | 9/2011 | Byun | A45D 33/02 401/278 |
| D654,792 | S | 2/2012 | Bertelsen | |
| 8,226,319 | B2 | 7/2012 | Francavilla et al. | |
| 9,247,805 | B1 | 2/2016 | Malm | |
| 9,332,830 | B1 * | 5/2016 | Thompson | A46B 11/0072 |
| 10,251,471 | B1 * | 4/2019 | Sanderson | A46B 5/0095 |
| D850,116 | S | 6/2019 | Schmidt | |
| D908,955 | S | 1/2021 | Gautier | |
| 11,154,126 | B1 * | 10/2021 | Zheng | B05B 11/1004 |
| D957,137 | S | 7/2022 | Gooden | |
| D981,247 | S | 4/2023 | Endo | |

(Continued)

FOREIGN PATENT DOCUMENTS

| | | |
|---|---|---|
| DE | 19811552 | 9/1999 |

OTHER PUBLICATIONS

International Search Report, PCT/US2023/027850, Oct. 3, 2020.

(Continued)

*Primary Examiner* — Jennifer C Chiang

(74) *Attorney, Agent, or Firm* — BATEMAN IP; Randall B. Bateman

(57) ABSTRACT

An applicator for applying a fluid such as a cream, lotion, serum, gel or other flowable material to a substrate may have fluid reservoir, a housing in which the reservoir moves to release flowable material and an applicator head for applying the flowable material to a substrate.

21 Claims, 12 Drawing Sheets

(56) References Cited

U.S. PATENT DOCUMENTS

| | | | |
|---|---|---|---|
| D984,046 | S | 4/2023 | Sherear |
| D990,784 | S | 6/2023 | Kim |
| D999,059 | S | 9/2023 | Tidwell |
| 2008/0317544 | A1 | 12/2008 | Spirk et al. |
| 2009/0311034 | A1 | 12/2009 | Pires et al. |
| 2011/0259359 | A1 | 10/2011 | Groh et al. |
| 2012/0093567 | A1 | 4/2012 | Kravchenko |
| 2012/0207531 | A1 | 8/2012 | Rusev |
| 2016/0279653 | A1 | 9/2016 | Brugger |
| 2019/0255305 | A1 | 8/2019 | Hendriks et al. |
| 2021/0316914 | A1 | 10/2021 | Tidwell |
| 2022/0232946 | A1 | 7/2022 | Cui |

OTHER PUBLICATIONS

Written Opinion, PCT/US2023/027850, Oct. 3, 2023.
International Preliminary Examination report, PCT/US2023/027850, Sep. 4, 2024.
Lotrimin Ultra® Athlete's Foot Cream with No Touch Applicator website—Exact date unknown, Approximate date 2022.

* cited by examiner

APPLICATOR FOR APPLYING CREAMS, SERUMS, LOTIONS, LIQUIDS, GELS AND OTHER FLOWABLE MATERIALS

RELATED APPLICATIONS

The present application claims the benefit of U.S. Provision Patent Application No. 63/389,772, Filed Jul. 15, 2022, and Provisional Patent Application No. 63/408,804, filed Sep. 21, 2022, both of which are expressly incorporated herein by reference.

BACKGROUND

State of the Art

The present disclosure relates to an applicator for applying creams, serums, liquids, gels and other flowable materials. In particular, the present disclosure relates to a novel applicator and method of using the same. Representative creams, serums, liquids and gels may include creams, serums, liquids and gels for pre-facials, post laser hair removal, warts, stretchmarks, face cleanser, anti-aging, blackheads, masks, hydrocortisone, skin bleaches, sunscreen, skin lightener/brightener, skin primer, post sunburn, insect repellent, under eye foundation, other makeup, aloe vera, lip corrector, hemorrhoids, skin tightener, pain relievers, anti-cramping, calamine, dark spot treatments, skin glow, steroids, moisturizer, eczema/rash medications, vulva or vaginal deodorants and anti-perspirants, post facial skin care, anti-fungals, penal/erection treatments, medicine, chemical peels, anti-ringworm, yeast infections, microdermabrasion, cold sore treatments, skin tag/mole treatments, body butters/lotions, creams, aesthetician support and practice creams, anti-itch medications, grease removers, skin coloring, hair coloring/developer, baby lotions and care creams, acne treatments, heal softeners, shaving creams and aftershave, professional hair products, callus removal, hair removal, hair defrizz, diaper rash, bunion treatments, post wax treatments, hair conditioner, ingrown toenail treatments, scalp treatments, nail fungal treatments, dandruff treatments, cuticle/cuticle dead-end treatments, sealants, hair straightener, beard oils, denture cream, tattoo creams and CBD/THC oils, topical medications and the like.

There are a variety of situations in which a person applies a cream, serum liquid, lotion, gel or other flowable material to a person's skin or other tissues. In particular with women, there are a variety of situations in which various liquids or creams or other flowable material are replied to the labium majora, labium minora or clitoris or Bartholin glands. For example, anti-itch creams or yeast infection ointments may be applied to the labium minora when a woman is suffering from a yeast infection or other irritation. Likewise, personal lubricant may be applied to the labium majora, clitoris and/or Bartholin glands when needed.

The manner of applying various creams, serums, lotions, and other flowable materials is varied. Sometimes the fluid material is placed on the person's finger and then applied. In other situations, it is disposed on a piece of toilet paper or some other disposable product and applied. The use of one's finger, however, it's not hygienic and can risk the transmission of disease either to or from the area surrounding the vagina. Additionally, the use of toilet paper or other disposables often makes it hard to apply the flowable material specifically to the desired location without also applying it to other locations where it may not be desired.

These concerns are also present if someone is applying a topical treatment to a cut or sore—with the risk of the person's unwashed hands potentially contaminating the wound. Similarly, a person wishing to apply foundation to his or her skin to cover a blemish may not want to get the material on his or her hand, where it may be accidentally transferred to a shirt or other clothing. Thus, it would be desirable to provide an applicator which can apply flowable material to the skin while keeping the hands of the person applying the material from coming into contact with the material.

Representative flowable materials may also include various food products. A person cooking may wish to apply marinade, sauces or oils to a piece of meat, fruit or vegetables or other food. For example, a person barbequing meat may wish to apply barbecue sauce to a piece of meat each time it is turned. Conventionally this includes dispensing the barbeque sauce into a bowl and then using a brush to apply the barbeque sauce to the meat. This dirties two items and often wastes excess barbeque sauce left in the bowl.

A person may wish to apply liquid or flowable butter to a piece of corn on the cob, or a person may wish to apply an oil and vinegar mixture to some vegetables on a platter while not applying the same mixture to other vegetables on the same platter.

Representative flowable materials may include paints, stains, glues, lubricants, solvents and strippers for various applications. For example, it is commonplace for a person who paints buildings to purchase a small can of paint in the same color to allow the person to touch up scuff marks or other damage to painted surfaces. Once the can is opened, however, the paint is exposed to air and can begin to set, thereby eventually making the rest of the paint unusable. Additionally, the paint applicator head which is used will often have to be discarded as paint dries in the bristles.

Similarly, applying lubricants, strippers, solvents and other materials can be a challenge. It would be beneficial to make such lubricants easier to use, such as, for example having an applicator which makes it easier to apply the lubricant, stripper, solvent, etc., to a particular portion of a part without getting the material on adjacent structures where it may not be desired.

Thus, there is a need for novel applicators for applying flowable material in a variety of applications.

SUMMARY OF THE DISCLOSURE

The following summary of the present disclosure is not intended to describe each illustrated embodiment or every possible implementation of the invention, but rather to give illustrative examples of application of principles of the invention.

In accordance with one aspect of the present disclosure, an applicator may be provided with a reservoir for holding a flowable material such as cream, serum, liquid, lotion, gel or other flowable material. As one example, the flowable material may be applied in the vaginal area. The applicator may include an applicator head cap with a contoured applicator head for applying the flowable material. For an applicator head may be in the form of a include brush which is sized to fit between the labium majora, and an actuator for selectively pumping the flowable material through the applicator head cap and applicator head (brush) so that it can be applied as desired.

In accordance with another aspect of the present disclosure the applicator may be selectively moved between a first position wherein the actuator may advance a plunger to pump flowable material through the brush or other applicator head, and a second position wherein pressing on the applicator does not advance the plunger or pump flowable material through the applicator head, thereby reducing the risk of accidental dispensing of the flowable material contained within the applicator's reservoir.

In accordance with another aspect of the present disclosure the applicator may include a one-way dispensing valve so that flowable material from the reservoir can be dispatched through the applicator head without retracting the flowable material back into the reservoir.

In accordance with another aspect of the present disclosure the reservoir may include a floating piston so as to provide a changing containment area for the flowable material being applied, thereby reducing the risk of a vacuum forming and drawing flowable material back into the reservoir.

In accordance with another aspect of the present disclosure, the applicator head cap may include a manifold for dispensing the flowable material in the applicator head, such as a manifold disposed within a brush to distribute flowable material within the brush. The applicator head cap or applicator head also may be disposable so that the applicator head may disposed of after each use or as frequently as desired while keeping the flowable material in the reservoir. Thus, a single applicator could be used over a period of time while the applicator head is periodically replaced to prevent buildup of microbes, stickiness of the applicator head to due to drying of the flowable material, or other general fouling of the applicator head.

The use of replaceable applicator heads may also be used to tailor the application of a flowable material to a specific situation. For example, the use of liquid bandage compounds, such as those sold under the mark NEW SKIN can be used for a variety of skin lacerations, ranging from being cut by a knife to getting road rash from a bicycle accident. Then sealing the knife cut, the user may desire to apply a very thin line of liquid bandage to cover the cut, while the victim of the biking accident may be using the liquid bandage to cover one or more patches of damaged skin of 10 or even 20 square inches (64.5 to 129 square centimeters). Thus, an applicator head designed for the cycling accident would be difficult to use to simply cover a cut, while the applicator head which could simply cover the cut would be difficult to use to cover the large areas of skin.

It will be appreciated that various aspects of the disclosure may be discussed together but are not required to carry out the invention as taught herein. The appended claims are intended to define the invention.

BRIEF DESCRIPTION OF THE DRAWINGS

Various embodiments of the present disclosure are shown and described in reference to the numbered drawings wherein.

Figure 1:
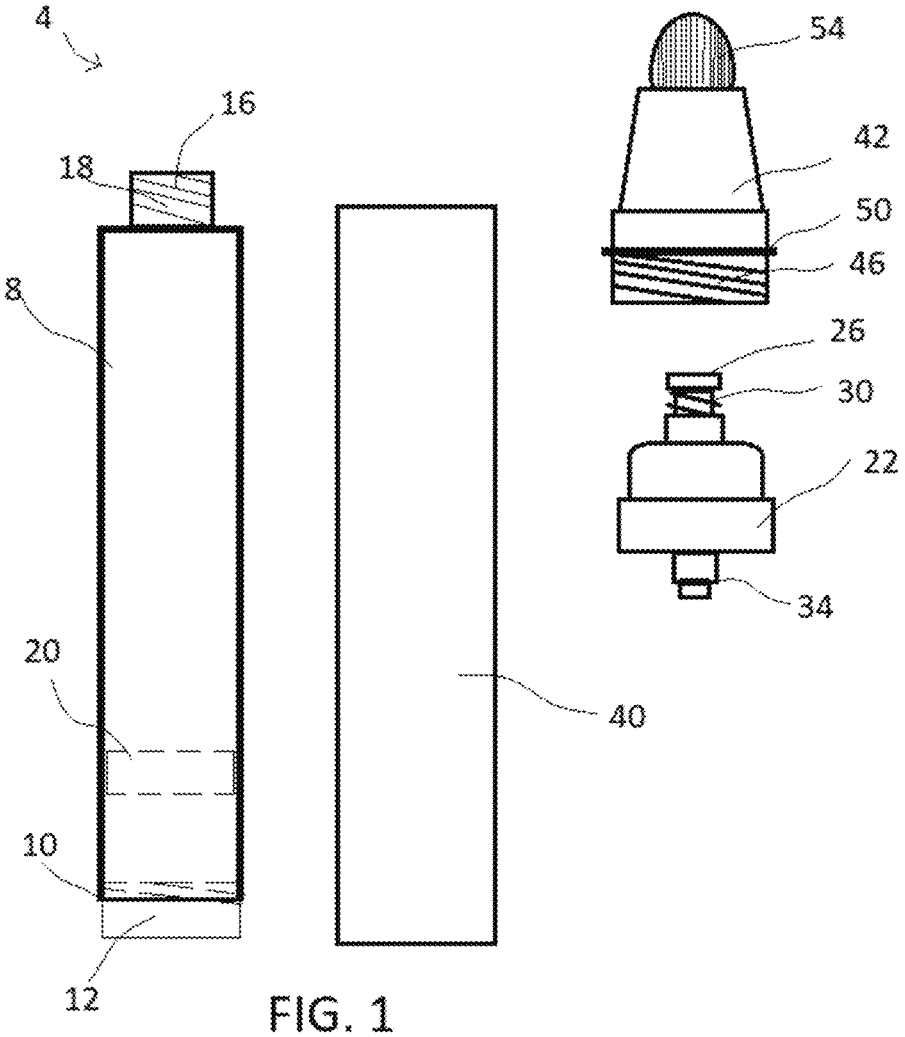
FIG. 1 illustrates a side, exploded view of the applicator for applying creams, serums, liquids, and gels.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other, or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without necessarily being exactly that quality. For example, a structure said to be generally vertical would be at least as vertical as horizontal, i.e. would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range, or the characteristics being described.

Turning now to FIG. 1, there is shown and exploded view of the applicator of the present disclosure. The applicator, generally indicated at 4, may include a reservoir 8 for holding fluids or other flowable material such as those discussed previously. The reservoir 8 may be defined by an outer wall which is generally cylindrical, or may have a rectangular cross-section. The outer wall may define a void for holding a flowable material as discussed herein.

The reservoir 8 may have a threaded lower opening 10, to which a bottom cap 12 may be attached. The bottom cap 12 may have an external wall which matches that of the reservoir in shape, or may have a different shape. The reservoir 8 may also include an upper collar 16, which may be threaded, generally opposite the lower opening 10. The upper collar 16 may include threads 18 for attaching a top cap 22, or may include annular flanges or the like for allowing a snap fit between the upper collar and the top cap. The top cap 22 may include a threaded inner portion (not visible in FIG. 1) for receiving a threaded upper collar 16 of the reservoir 8, or may include annular flanges or other structures allowing for a snap fit between the top cap and the upper collar.

Disposed in the top cap 22 may be a one-way valve 26 configured such that pressing on the one-way valve causes an amount of cream, gel or other flowable material to be dispensed from the reservoir 8. A biasing element, such as a spring 30 may be used to return the one-way valve 26 to its initial position. The one-way valve 26 may be connected to a suction tube 34 which extends into the collar 16 and the reservoir 8.

Also shown in FIG. 1 is an outer housing 40 which may have an open upper end and a generally open bottom end which may receive the reservoir 8 so that the bottom cap 12 extends beyond the bottom end of the outer housing. Thus, the outer housing 40 may have a void defined by an outer wall which may have an interior diameter which is slightly larger than the outer diameter of the outer wall forming the reservoir.

Figure 8:
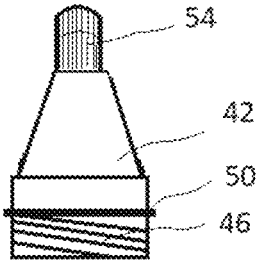
FIG. 8 shows a side view of the cap portion.

The upper end of the outer housing 40 may be threaded and receive a threaded portion 46 of an applicator head cap 42. Alternatively, the upper end of the outer housing 40 may include an annular flange or other structure which allows a snap fit or other engagement to hold the outer housing and applicator head cap 42 together. Advancement of the applicator head cap 42 may be limited by a projection or radial flange 50 which engages the upper end of the outer housing 40. The applicator head cap 42 may also include an applicator head 54 which may be contoured so as to thinner in one dimension and rounded on the top as shown in FIG. 8. The applicator head 54 shown in FIG. 1 is in the form of a rounded brush, but other applicator heads may be used as discussed below.

Figure 2:
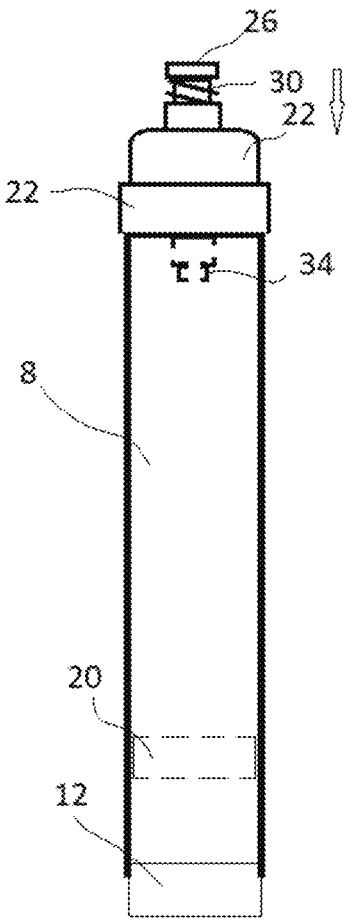
FIG. 2 shows a side view of the fluid reservoir with the reservoir cap, reservoir base, and one way valve attached there too.

Turning now to FIG. 2, there is shown a side view of the reservoir 8 having the bottom cap 12 in place on the bottom end of the fluid reservoir, and the top cap 22 disposed on the top end of the fluid reservoir. As the one-way valve 26 is pressed down as indicated by the arrow, a given amount of the flowable material, e.g., cream, lotion, serum, gel, or other flowable material, is drawn through suction tube 34 dispensed out of the one-way valve 26 and out the applicator head cap 42 (FIG. 1). As the flowable material is dispensed, the vacuum formed in the reservoir 8 causes the floating plunger 20 to be drawn upwardly, thereby reducing the effective volume of the fluid reservoir. It be appreciated at a hole may be left in the lower end of the fluid reservoir 8 or the bottom cap 12 to allow air inflow into the area below the floating plunger 20 to thereby prevent a vacuum from forming.

Figure 3:
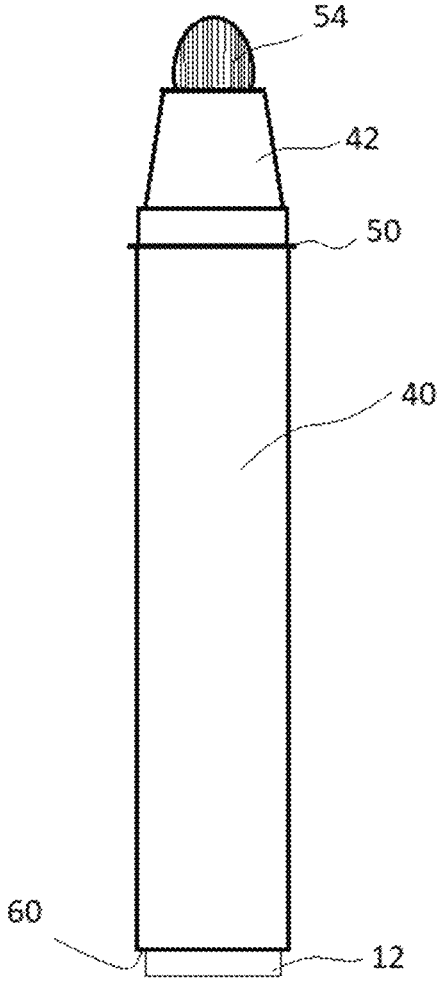
FIG. 3 shows an assembled view of the applicator having a cover sleeve disposed about the fluid reservoir and a disposable cap disposed thereon.

FIG. 3 shows a side view of an assembled applicator 4. The reservoir (not visible) is disposed within the outer housing 40 and held in place by the top cap (not shown) engaging the applicator head cap 42 and the flange 60 on the bottom end of the outer housing. Pressing upwardly on the bottom cap 12 moves the fluid reservoir upwardly, and effectively causes downward movement of the one-way valve 26 relative to the reservoir. (In reality the one-way valve remains generally stationary while the fluid reservoir moves upwardly).

Figure 4:
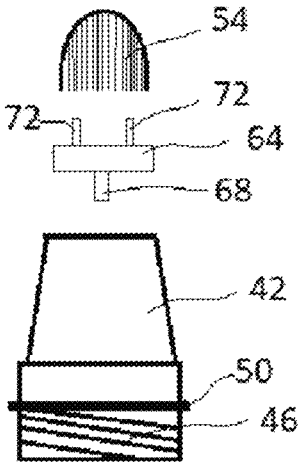
FIG. 4 shows an exploded view of the applicator head cap shown in FIGS. 1-3.

The flowable material which is dispensed from the reservoir out the one-way valve and through the applicator head cap 42 to the applicator head 54 where it can be applied to the desired anatomical surface. FIG. 4 shows an exploded view of the applicator head cap 42. The applicator head cap 42 may include a base portion with a threaded portion 46 at one end and a cavity for receiving a manifold 64. The manifold may include an intake 68 for receiving a quantity of flowable material from the reservoir 8 and one-way valve 26 and a plurality of dispensing tubes 72 for injecting the flowable material into the applicator head 54 to facilitate more even distribution.

Figure 5:
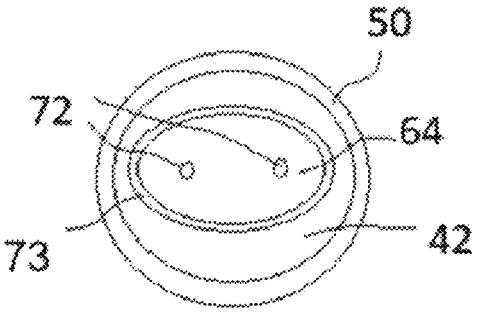
FIG. 5 shows a top view of the cap portion of the applicator head cap having the manifold disposed therein.

FIG. 5 shows a top view of the applicator head cap 42 with the applicator head removed so as to show the manifold 64 resting in the cavity 73. The dispensing tubes 72 are shown being spaced apart. While only two tubes are shown it will be appreciated that three or more tubes may be used. Additionally, the tubes may be formed from a flexible material to allow them to deflect as the applicator head is being used. The flange 50 which engages the top of the outer housing (FIG. 3) is also shown.

Figure 6:
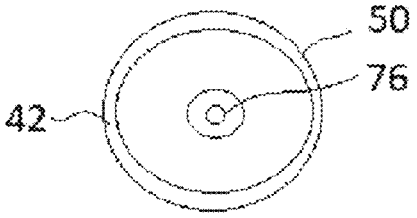
FIG. 6 shows a bottom view of the cap portion of the applicator head cap having the manifold formed therein.
Figure 7:
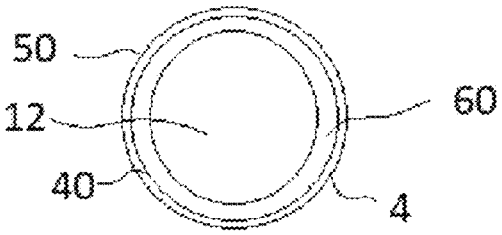
FIG. 7 shows a bottom view of the applicator.

FIG. 6 shows a bottom view of the applicator head cap 42. The flow tube 76 which engages the one-way valve (FIG. 2) is shown, as is the flange 50. FIG. 7 shows a bottom view of the applicator 4. The bottom cap 12 extends beyond the flange 60 at the bottom of the outer housing 40. Pressing on the bottom cap 12 pushes the fluid reservoir upwardly and causes the fluid contained therein to be dispensed into the applicator head 54 (FIG. 1). FIG. 8 shows a side view of the applicator head cap 42, wherein the applicator head 54 is thinner in one dimension. The thinner part facilitates the use of the applicator head for applying cream, lotion, serum, liquid or gel to the clitoris, labium, or other anatomical structures. It will be appreciated that the different fluids which may be applied may include medication, anti-itch ointments, personal lubricant and the like.

Figure 9:
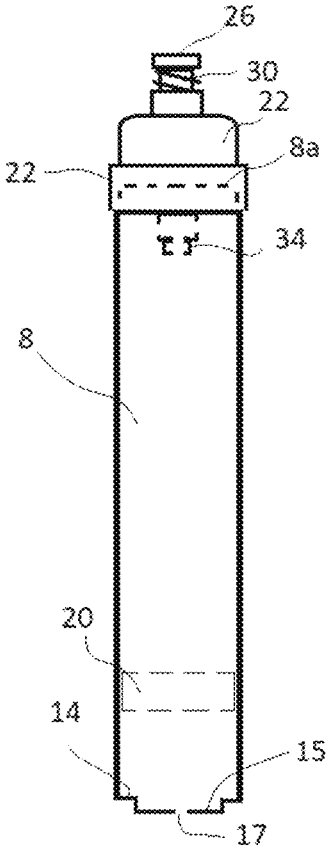
FIG. 9 shows a side view of an alternate embodiment of the fluid reservoir.

Turning now to FIG. 9, there is shown a side view of fluid reservoir 8. Rather than using a bottom cap 12 (FIG. 2), the reservoir 8 may have a generally continuous bottom with a shelf 14 and a projecting portion 15 for extending beyond the flange 60 of the outer housing 40. The floating plunger 20 can be inserted from the top of the f reservoir 8 by having the upper end 8*a* being open and the top cap mounting to the exterior of the fluid reservoir to close it. This enables the floating plunger 20 to be inserted in through the top prior to filling of the reservoir 8. An airhole 17 may be provided to allow air into the reservoir as the floating plunger 20 moves upwardly as the lotion, liquids, etc., is dispensed, to thereby prevent a vacuum from forming below the plunger.

Figure 10:
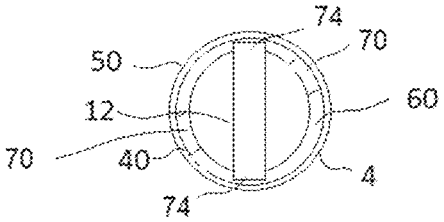
FIG. 10 shows a bottom view of a selectively closeable applicator.

FIG. 10 shows a bottom view of an applicator 4. The radial flange 50 of the applicator head cap may be seen, along with the outer housing 40 disposed about the fluid reservoir (not shown). The bottom of the outer housing includes the flange 60 with one or more slots or openings 70 formed therein. The bottom cap 12 or the bottom of the fluid reservoir (if using the embodiment shown in FIG. 9) may include one or more projections 74 which are configured to align with the openings 70 when in the applicator 4 is in an opening position and to align with the flange 60 when shown in a closed position, such as shown in FIG. 10. When in the opening position, the bottom cap 12 can be pressed inwardly and the projections 74 can move in the slots or openings 70 to allow the fluid reservoir 8 (FIG. 2) to move into engagement with the applicator head cap and dispense liquid. When in the closed position as shown in FIG. 10, the one or more projections 74 engage the flange 60 and prevent the fluid reservoir from being moved upwardly to dispense the lotion, cream, gel, etc., disposed therein. Those skilled in the art will appreciate that a person may not wish to carry an applicator in a purse or briefcase if incidental bumps to the bottom cap could cause the flowable material to be dispensed and get on materials in the purse or briefcase.

Figure 11:
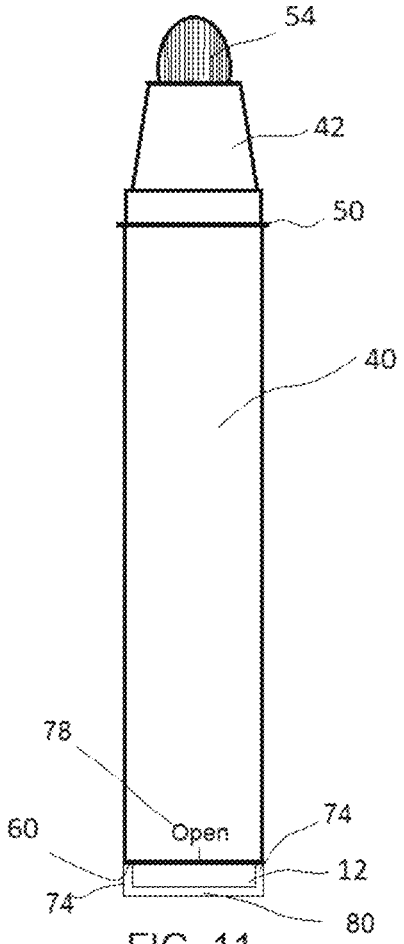
FIG. 11 shows a side view of a selectively closeable applicator in a closed position.
Figure 12:
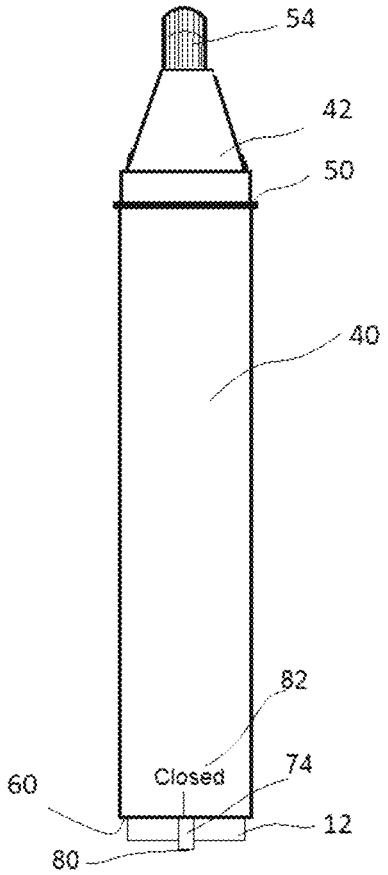
FIG. 12 shows an alternate side view of the selectively closeable applicator in a closed position.

FIG. 11 shows a side view of the applicator 4 with the projection 74 disposed out of alignment with the slots or openings (not visible) so that the contents of the fluid reservoir (not show) cannot be dispensed. The projections 74 may be attached to one another by a rib 80. The position for the projections 74 to be rotated to is indicated by the open marking 78. FIG. 12 shows a side view of the applicator 4 in the closed orientation with one projection 74 and the rib 80 being in alignment with the closed marking 82.

Figure 13:
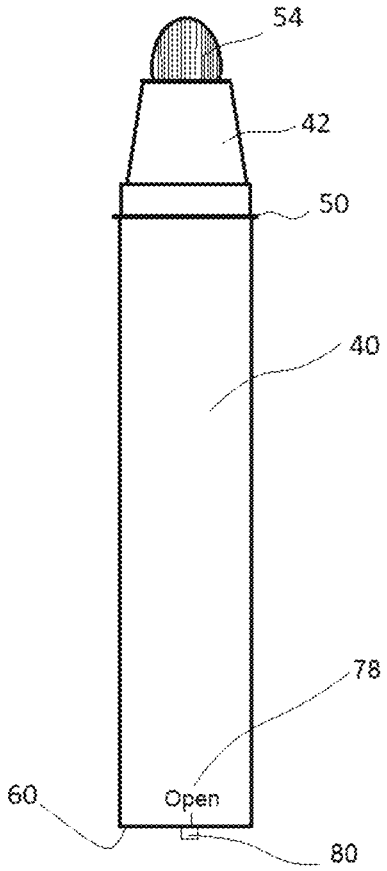
FIG. 13 shows the selectively closeable applicator in an open, dispensing orientation.

FIG. 13 shows the bottom cap 12 having been rotated so that the projection 74 and rib 80 are in alignment with the open marking 78 and the bottom cap pushed inwardly so that only the rib 80 remains showing. This movement causes the fluid reservoir inside the housing 40 to move upwardly, thereby dispensing flowable material through the applicator head cap 42. Thus, the user is able to rotate the bottom cap to lock the applicator in a closed position and then rotate the bottom cap so that the projections are in alignment with the opening position and flowable material can be pumped out of the applicator.

It will be appreciated from the present disclosure that the difference between the locked or closed position and the open position need not be 90 degrees as suggested by FIGS. 11-13. As shown in FIG. 10, the rotation of the bottom cap 12 forty-five degrees would move it from the closed position to the open position. Moreover, detents or other structures could be used on the flange to keep the projection(s) 74 in the closed position until the user rotates them into alignment with the slots or openings 70 in the flange.

Figure 14:
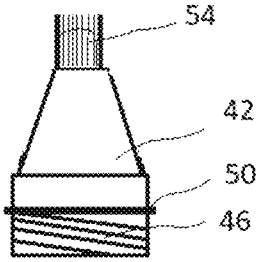
FIG. 14 shows an applicator head cap with an alternate applicator head configuration.

FIG. 14 shows an alternate view of the applicator head cap 42. While the applicator head may be elongate in one direction for some application, such as applying anti-itch crème for a yeast infection or applying diaper rash crème the applicator head 54 may be more cylindrical for applying other flowable material, such as serum for treating age spots or freckles. It will be appreciated that the applicator 4 of the present disclosure can be used for a wide variety of purposes including applying cosmetics, skin care treatments, antiseptics, and antibiotics and even sunscreen and the like.

It will be appreciated that the fluid reservoir could be made to be refillable, such as by the removal of the top cap, or can be made for single use only, such as adhesively attaching the bottom cap or top cap.

Figure 15:
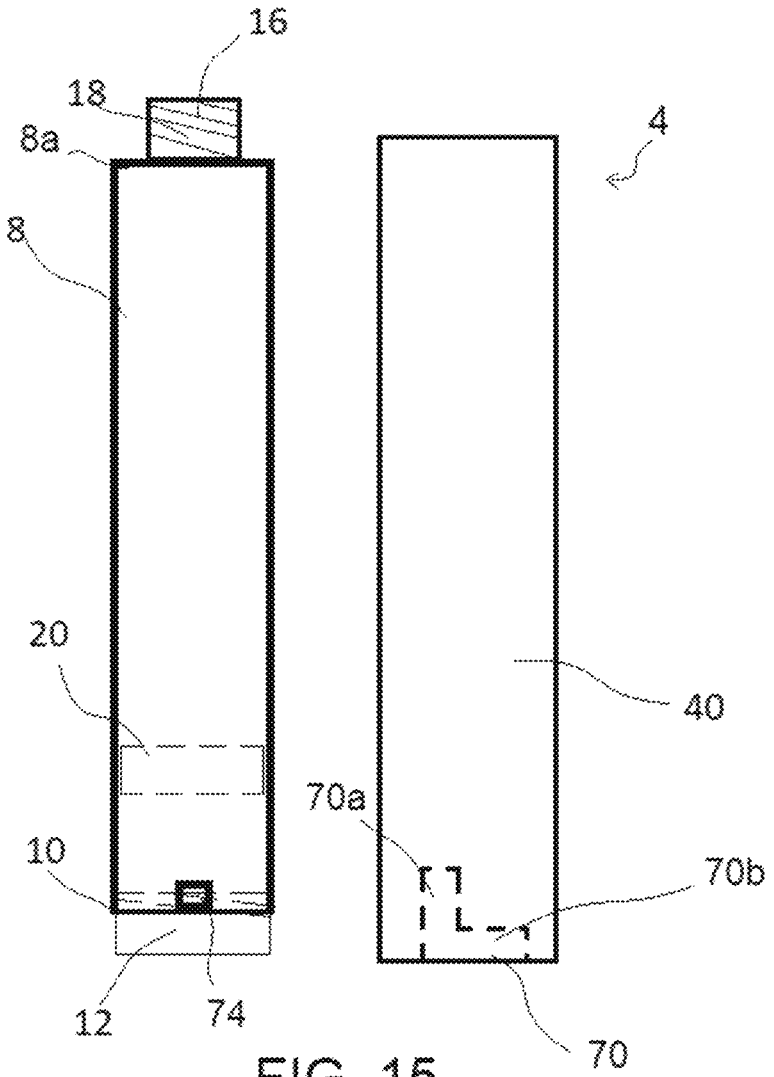
FIG. 15 shows a side view of the reservoir and outer housing which cooperate to selectively prevent actuator of the applicator.

Turning now to FIG. 15, there is shown an exploded side view of the reservoir 8 and outer housing 40 which cooperate to selectively prevent actuation of the applicator 4. Disposed along the body forming the reservoir 8 may be a projection 74 extending outwardly from the reservoir. Disposed in the body of the outer housing 40 is a channel or slot 70. The Slot 70 may be generally L-shaped or J shaped and the reservoir 8 may be rotatable within the outer housing 40 so that the projection 74 may be disposed in a first portion 70*a* of the slot 70 which extends vertically sufficiently that the projection may travel along the slot for the reservoir 8 to move and dispense some of the flowable material contained therein. The second portion 70*b* of the slot does not extend vertically (i.e., longitudinally toward the top end of the outer housing 40 and top, dispensing end 8*a* of the reservoir 8). Thus, when the projection 74 is disposed in the first portion 70*a* of the slot 70, the applicator 4 is in the open position and the reservoir may be advanced to dispense flowable material as discussed above. When the reservoir 8 and outer housing 40 are rotated with respect to one another that the projection is disposed in the second portion 70*b* of the slot 70, the applicator is in a closed position and the reservoir cannot be advanced relative to the outer housing to thereby dispense flowable material. While discussed as the projection 74 being on the reservoir or bottom cap and the slot being in the outer housing, it will be appreciated that the structures may be reversed with the slot being formed on the reservoir and the projection being disposed on the out housing.

Figure 16:
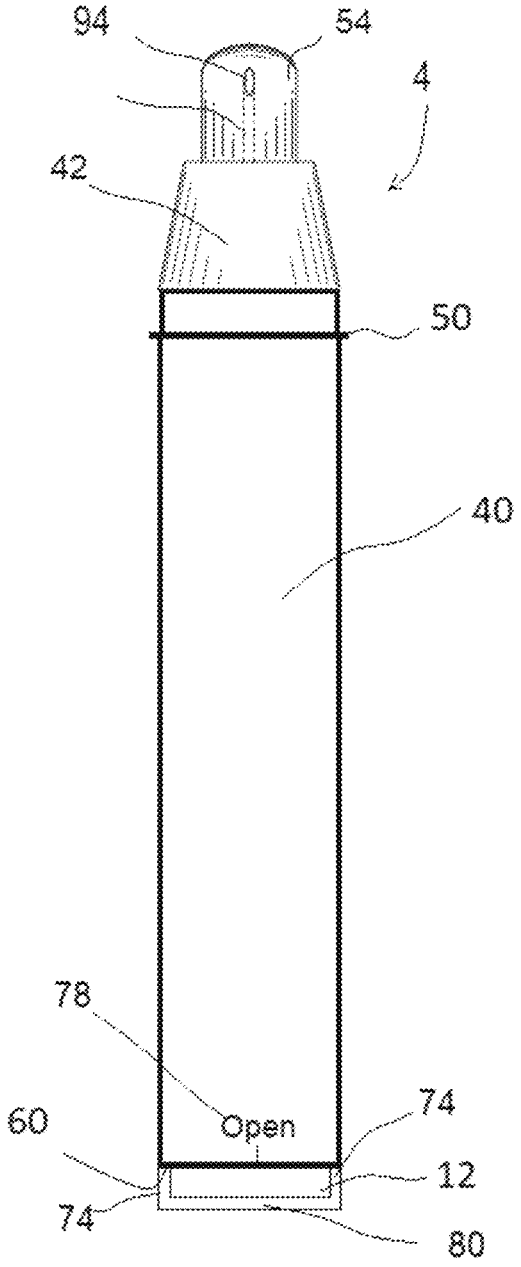
FIG. 16 shows a front view of an applicator having an alternate applicator head.

FIG. 16 shows a front view of an applicator 4 having an alternate applicator head 54. Rather than using a brush with a number of bristles, the applicator head 54 may be formed from a single piece of material. The material may be any of a variety of plastic and plastic like materials, such as polymers or silicone. In many applications is it desirable that the applicator head 54 be flexible so as to allow the applicator head to flex as the flowable material is applied to a user's skin or to any other substrate.

The applicator head 54 may include one or more channels 90 extending therethrough, which may terminate in one or more openings 94 which are in fluid communication with the channel. When the reservoir disposed inside the outer housing 40 is advanced, the flowable material advancing out of the reservoir passes through the applicator head cap 42, through the channel(s) 90 and out through the opening(s) 94 so that it may be applied by the applicator head 54. The single piece applicator head 54 allows for a smooth application of the flowable material. It also allows for easy reuse of the applicator. While leaving creams, ointments and other materials between the bristles of a brush may result in the brush becoming dirty, smelly and hard over time, the single piece brush allows the brush to be easily cleaned after each use. Once the cream, ointment, etc. has been applied, the applicator head 54 can be cleaned with a baby wipe, paper towel or sanitizing wipe to remove any excess cream, ointment, etc., and to sanitize the brush if desired. In such a manner, a tube of ointment can be used to directly apply such flowable material without the risk of contamination, without the requirement that the user washes their hands, and without the brush being fouled by the ointment, etc.

It will be appreciated that the applicator head 54 may be formed in various configurations depending on the particular flowable material to be disposed in the reservoir and the substrate to which it is likely to be applied. For example, when applying paint to a wall to cover a scuff mark, a thumbtack hole or to repair some other blemish, it may be desirable to have a generally flat surface on the applicator head 54 which acts to spread and smooth the paint on a flat surface, such as to a wall, and thereby allow the paint to be applied evenly. It will be appreciated that the size of the applicator head 54 may be adapted to the intended use. Thus, for example, a contractor or homeowner may obtain an applicator 4 which is 0.25 inches wide if the purpose of the brush is to cover nail holes on a room being remodeled. Alternatively, a contractor or homeowner may obtain an applicator with an applicator head which is between 0.5 and 1.5 inches wide if the paint will be used for general touch-ups around a house. Alternatively, a homeowner may obtain an applicator which is 3 inches wide to facilitate applying paint along the edge of a wall so that a roller can be used on the remainder of the wall without having to approach the adjoining wall, ceiling or floor too closely and inadvertently get paint on the adjoining wall etc. Thus, applicators 4 can be sold varying applicator head sizes, such as 0.25, 0.5, 1.0, 1.5, 2.0, 2.5 and 3 inch widths—thereby allowing the user to pick the applicator head which best works for their application. The applicator 4 could even be sold with applicator heads in much larger sizes, such as 5 inches or 6 inches wide depending on the application to which the applicator will be used.

Because the paint is dispensed by pressing on the bottom of the reservoir 8 or the rib 80 and the applicator 4 has a closeable valve 30, the paint in the fluid reservoir is not exposed to air, opening a paint can. The paint is thus less likely to cross-link or dry like paint left in a can. When the painting is done, the paint on the applicator head 54 and in the channel 90 can be removed by dipping the brush 34 into paint thinner or simply wiping off the applicator head with a wipe. This requires considerably less paint thinner than a conventional paint brush and can remove the paint better because the paint is not held within bristles. Thus, fewer paint brushes will be discarded, and less paint thinner is used, both helping the environment.

It will further be appreciated that the applicator can be used to apply condiments and the like. Each push of the reservoir will typically dispense a generally known dose of the flowable material. In a restaurant it is often desirable to have standardized procedures for applying given amounts of condiments on a sandwich, hamburger, etc. Commonly restaurant employees squirt mayonnaise, ketchup and mustard on a sandwich, etc., from a squeezable bottle containing the condiment. There can be substantial differences in the amount being applied depending on the employee. This can also ruin the taste of a sandwich if it is doused in one condiment and has little of the others. Using the applicator 4 discussed herein, the restaurant may dictate the amount of an ingredient much more accurately. Thus, when making a sandwich, the employee may select the applicator holding mustard, advance or click the reservoir once and apply it to the sandwich. The same process may be repeated, with two clicks for mayonnaise and two clicks for ketchup. Thereby the restaurant can ensure consistency in its product. Additionally, if customers are familiar with the amount being supplied, a customer who prefers mustard may ask for two clicks of mustard and only one of mayonnaise—thereby knowing much more precisely the amount of mustard and mayonnaise will be on their sandwich.

Figure 17:
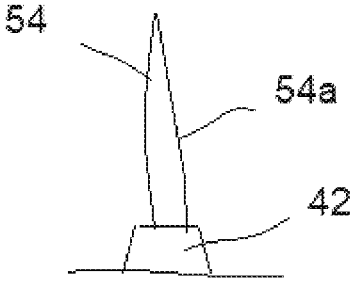
FIG. 17 shows a close-up view of an applicator head.

Thus, as shown in FIG. 17, the applicator head 54 may include a face 54*a* which can be used to apply the flowable material. The face 54*a* may be substantially flat so that it may be used to apply a smooth coat of paint, stain or other material to a substrate. Such an applicator is desirable where the flowable material is preferentially evenly spread on the substrate which is generally flat.

Figure 18:
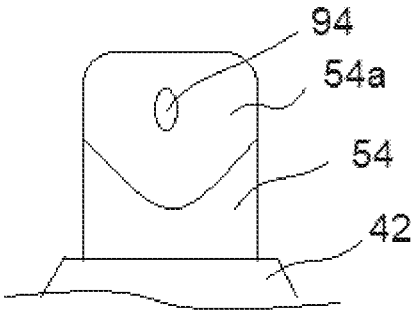
FIG. 18 shows a fragmented front view of an applicator head and applicator head cap.

In contrast, the applicator head 54 in FIG. 18 has a face 54*a*, at least a portion of which may be concave. Having a concave face 54*a* may provide benefits when applying a variety of flowable materials to convex surfaces. For example, an anti-fungal cream or nail polish may be applied with an applicator 54 having a concave face which generally matches that the curvature of fingernails or toenails. Likewise, an applicator may have an applicator head 54 with a face 54*a* which is contoured to match the curvature of eyelids for applying an under-eye cream or serum to be applied to the upper eyelid.

Figure 19:
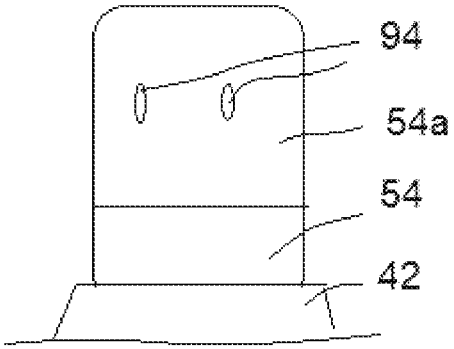
FIG. 19 shows a fragmented front view of another applicator head and applicator head cap.

FIG. 19 shows an applicator head 54 attached to a brush cap 22 in which the applicator head 54 has a generally flat face 54*a*. The applicator head 54 is wider than the applicator head in FIG. 16, and thus may include a plurality of holes 94 for releasing the flowable material. The number and size of the holes may depend, in part, on the width or length of the applicator head, as well as the viscosity of the flowable material. Thus, flowable materials which have very low viscosity may require only 1 small hole, while a more viscous flowable material may require the use of 2 or 3 larger holes for the same sized applicator head. The holes may be disposed in a straight line across the applicator head, or may be offset to provide adequate support within the applicator head so that the applicator head cannot be easily torn or damaged in the area of the openings.

Those who sell the flowable materials can design the applicator head 54 in accordance with the likely use and flowability of their product. For example, a 3-inch-wide applicator head may have 3 holes evenly spaced across the applicator head, or may rely on a single hole due to the viscosity and spreadibility of their product.

Figure 20:
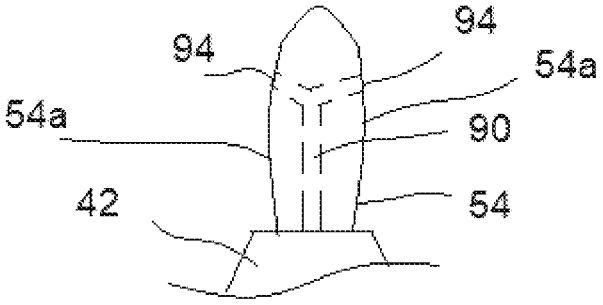
FIG. 20 shows a side view of another applicator head and head cap.

Turning now to FIG. 20, there is shown an applicator head 54 which has 2 faces 54*a* on opposing sides of the brush. Additionally, the channel 90 is provided with two or more openings 94 so that a flowable material may be applied to both faces. Such an applicator head 54 would be useful for purposes where it is desirable to apply a flowable material to both sides of a structure. For example, above there is discussed the application of vaginal creams, such as those used for yeast infections, and personal lubricants. The applicator head 54 could be used to apply such flowable materials with a single pass. Once finished, a baby wipe or sanitary wipe can be used to wipe off the applicator head 54, thereby leaving it clean for the next application.

Figure 21:
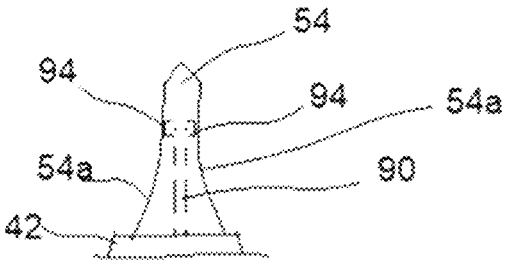
FIG. 21 shows a side view of another applicator head and head cap.

While FIG. 20 shows an applicator head 54 having two convex faces 54*a*, it will be appreciated that an applicator head 54 may have 2 concave faces 54*a*, such as may easily be places between the gluteus maximus of a child suffering from diaper rash as is shown in FIG. 21. Each of the convex faces 54*a* may have an opening 94 so that flowable material passing through the applicator head cap 42 and the channel 90 are dispensed on both sides of the applicator head 54.

Figure 22:
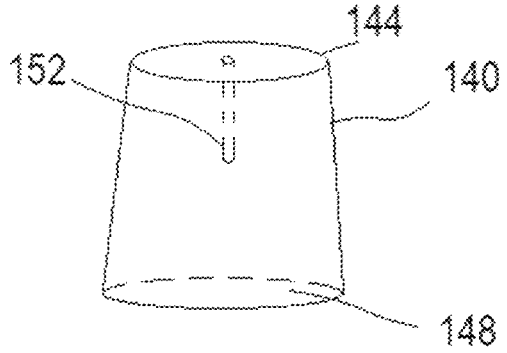
FIG. 22 shows a side view of an applicator head cover.

FIG. 22 shows an applicator head cover 140. The applicator head cover 140 may include a body 142 having a first, closed end 144 and a second, open end 148 extending from the first, closed end 144 may be a projection 152 which is sized to fit into the opening 94 (FIG. 23) in the applicator head 54 (FIG. 23) and a short distance down the lumen or channel 90. In such a manner the projection 152 keeps the contents of the lumen from being exposed to the air, which may cause the flowable material to dry out. While a small amount of the flowable material may be displaced by the projection 152, the projection and or the applicator head 54 may be made from a material to which the flowable materials will not readily stick. Thus, the applicator head 54 and the projection 152 may be wiped off to remove any trace amounts of the flowable material which may have dried thereon. In such a manner the contents of the fluid reservoir 8 (FIG. 23) can be kept fresh for an extended period of time which may be used in accordance with aspects of the present disclosure.

Figure 23:
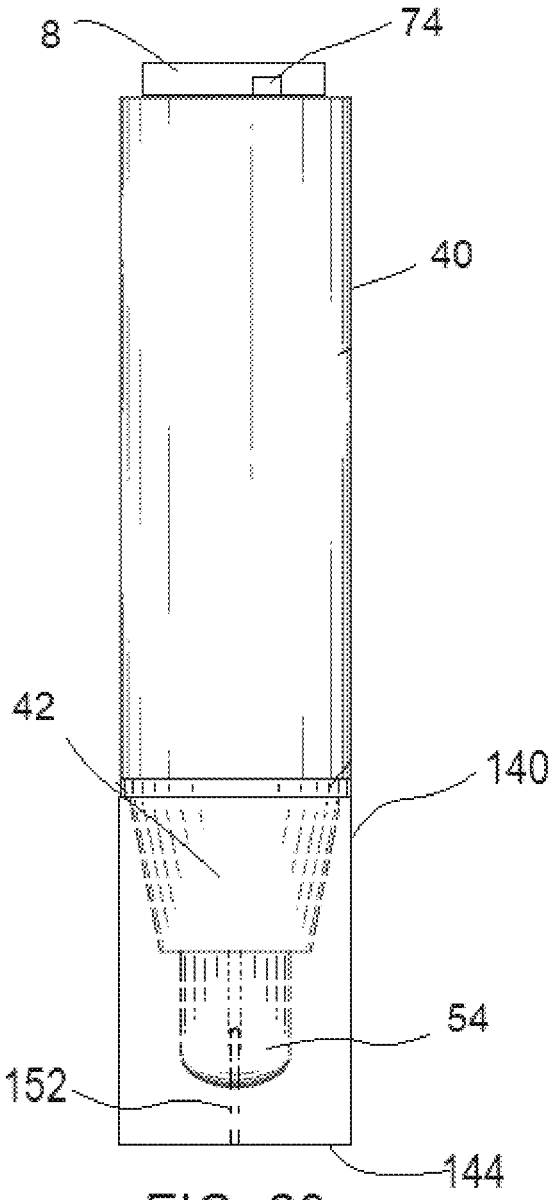
FIG. 23 shows a brush cap cover which may be used in accordance with aspects of the present disclosure.

FIG. 23 shows a front view of the applicator 4 being stored in a vertical orientation. The brush cap cover 140 may have a generally flat first, closed end 144 so that the cover may be positioned with the second, open end 148 on top so that the applicator 4 may be held with the applicator head 54 pointed down. Such an orientation is advantageous for reducing the footprint of the applicator 4 while being stored.

Figure 24:
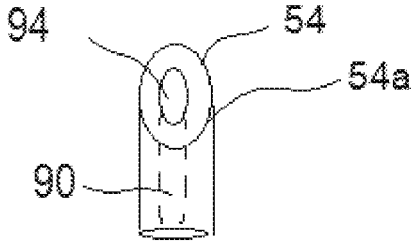
FIG. 24 shows a front view of the applicator being stored in a vertical orientation with the cover being disposed on the applicator head.

It will be appreciated that multiple applicator head 54 configurations can be used in conjunction with an applicator. Additionally, as is discussed below, the applicator 4 may be made so that applicator heads 54 may be interchanged, thereby allowing the user to use the applicator head which is most appropriate for the particular application. FIG. 24 shows an applicator head 54 which is generally cylindrical, and which has a beveled or sloped face 54*a* with the opening 94 formed therein. Such an applicator head configuration may be beneficial for applying lip gloss, applying a liquid bandage fluid to a small area, applying anti-wart or anti-blemish compounds, applying anti-itch medication to a mosquito bite or other bug bite, applying anti-acne cream or any other flowable material which the user wishes to apply to a small area without getting the flowable material and adjacent substrate. This can be of particular importance with some medications. For example, ant-wart compositions often cause the wart to blister after the composition is applied, thereby helping to remove the wart and its roots from the skin. In is important, however, not to get the composition on the skin adjacent to the wart—because it will likewise cause blistering of the skin. Using an applicator head 54 with a small diameter opening would facilitate application of such medications while minimizing the risk of the medication damaging healthy skin nearby.

Figure 25:
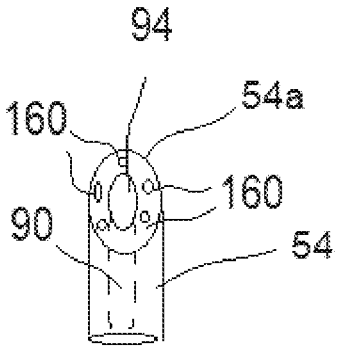
FIG. 25 shows an applicator head which may be used in accordance with the present disclosure.
Figure 26:
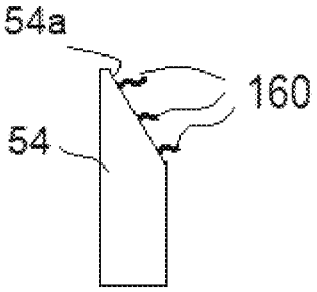
FIG. 26 shows an applicator head which may be used in accordance with the present disclosure.

FIG. 25 shows an applicator head 54 which is similar to that shown in FIG. 24, except that the face 54*a*, about the opening 94, may have a plurality of projections 160. Depending on the size and material of the projections, the projections may be used for massaging the skin or from roughening an area to which the flowable material may be applied. The projections 160 may be between 0.004 and 0.04 inches (0.1 mm to 1 mm) in diameter and between 0.004 to 0.12 inches (0.1 mm to 3 mm) in length. FIG. 26 shows a side view of the applicator head 54 of FIG. 25.

Figure 27:
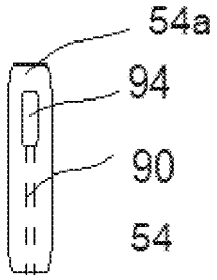
FIG. 27 shows an applicator head which may be used in accordance with the present disclosure.
Figure 28:
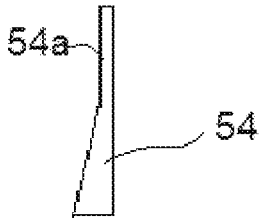
FIG. 28 shows a side view of an applicator applying a flowable material to a substrate.

FIGS. 27 and 28 show front and side views respectively, of another applicator head 54. The applicator head 54 is very thin and enables the portion with the face 54*a* to bend easily, allowing the brush to be inserted into small spaces, such as may be useful to applying a lubricant to a bolt or other structure, or to apply flowable materials to areas of the skin which may be very fragile, such as applying ointment to burned skin.

Figure 29:
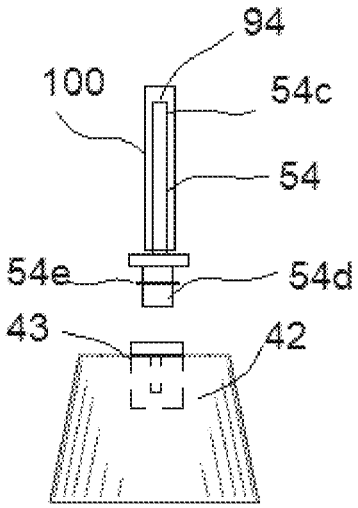
FIG. 29 shows a side view of yet another applicator head.

It will be appreciated that the applicator 4 may be configured to receive one or more of the applicator heads 54 so that the applicator heads are disposable. Such a configuration may also allow a variety of different applicator heads to be used on the same applicator. FIG. 29 shows an applicator head 54 which includes a lone tube 54*b* with an open end 54*c* forming an opening 94 at one end through which flowable material may be dispensed. Such a configuration may include a thin conduit so that a small amount of a flowable material may be applied to a specific area—such as applying ani-wart compositions to a wart or applying oil or glue to a precise location. Alternatively, a porous covering 100 may be used to spread out the flowable material.

The opposing end 54*d* of the applicator head 54 may include threads, annular flanges 54*e* or other structures allow the applicator head 54 to be screwed onto, snap fit to or otherwise attached to the applicator head cap 42. The applicator head cap 42 may include an attachment collar 43 which is threaded, has annular flanges or otherwise received and hold the end 54*d* of the applicator head 54 so that flowable material may be ejected through the applicator head. It will be appreciated that any of the applicator heads 54 discussed herein could be formed to be releasably attachable from the applicator head cap 42. Thus, an applicator could be sold with multiple applicator heads 54 of the same time, so that they can be replaced when needed. Alternatively, the applicator could be sold with a variety of applicator heads to allow the user to select the applicator head which is best for his or her application.

One beneficial use of the applicator of the present disclosure is a controlled quantity application. Most prescriptions that people take are in pill form so that the physician can instruct his or her client, for example, to take 1 pill twice per day. This ensures that the patient is taking the proper dose of the medication. Many diseases of the skin are treated with medicated creams, lotions or the like. These lotions are often sold in squeeze tubes or tubs, thereby making it difficult for the patient to apply the proper dose. This can result in the patient applying the wrong amount. If the medicated lotion is underapplied, the patient may not recover from the condition or receive proper relief for a chronic condition. If the medicated lotion is over applied, the patient may not receive the proper benefit and may exhaust their prescription early.

A good example is the topical medication Opzulera sold by Incyte Corp. The medication is FDA indicated for vitiligo and atopic dermatitis and will likely be indicated for psoriasis in the future. Thus, the medication has the ability to help many people. The medication, however, is very expensive, running up to $2000.00 per tube. While a tube should last for 6 months for a given area of treatment, dermatologists are having patients that have exhausted their supply in less than two months. The patient may then be forced to purchase a supply out of pocket, as an insurance company knows the amount which should have been used.

The applicator 4 can be constructed to assist patients with proper dosing. For example, if the proper dose to treat the affected area is 2 ml per day (approx. 0.068 oz.), an applicator can be constructed to dispense 2 ml each time a bottom cap 12 is pressed to raise the reservoir 8 and activate the one-way valve 26. Thus, a reservoir may contain 120 ml (approx. 4 oz.) to provide 60 doses for a two-month supply. The patient may be informed that a single dose each day is adequate and advised that if they use more, they will exhaust their supply before a refill is available.

If another patient has a larger area to be treated and needs 4 ml per day (approx. 0.135 oz.), the patient may be told to use click the bottom cap 12 twice each day so that the applicator provides a 30-day supply. In such a manner that the patient is able to obtain a proper dose and will not need to worry about running out of medication before their next refill is approved.

The use of a plastic or silicone applicator head 54 would be advantageous in such a situation as there would not be a loss of medicated lotion left in a brush. Additionally, the patient need not use toilet paper or a cloth to apply the medicated lotion, which could absorb some of the lotion, throwing off the dose and potentially reducing the effectiveness.

Also, it will be appreciated that Opzulera is not the only medicated lotion or cream which may be used. A representative list includes, but it is not limited to, Acne combo cream, Dapsone cream, Azelaic cream, Triple rosacea cream, wart peel cream, cosmetic numbing gel, anti-fungals, topical steroids, hair loss RX solution, and lightener creams.

It will be appreciated that the present disclosure teaches various structures which may be used in an applicator. It will be appreciated that the various structures can be used in combination and that features shown in one drawing may be used in conjunction with features shown in other drawings. Among other things, an applicator in accordance with the present disclosure may include: a reservoir, an outer housing disposed about the reservoir, at least one of the outer housing with the reservoir having a projection disposed thereon for selectively engaging the other of the outer housing and reservoir to selectively prevent movement of the reservoir relative to the outer housing in a manner which could cause flowable material to be ejected from the housing. The applicator may also include an applicator head attached to the outer housing, a valve attached to the reservoir and/or an applicator head disposed in communication with the reservoir for receiving flowable material from the reservoir. The applicator may include a fluid reservoir which has a floating plunger disposed therein, with the floating plunger moving as fluid is dispensed from the fluid reservoir. The applicator may further comprise a top cap attached to the fluid reservoir, the top cap containing a valve and a suction tube extending into the fluid reservoir. The applicator may also include an applicator head cap for holding the applicator head and the outer housing together, the reservoir being disposed at least partially within the outer housing.

The applicator may also include an outer housing is threadedly attached to applicator head cap. The applicator may also have a manifold disposed in an applicator head cap, which may have an intake and a plurality of dispensing tubes and wherein the dispensing tubes extend to a position within the applicator head. The applicator may comprise a bottom cap attached to the reservoir, and which may be removably attached to the reservoir. The applicator may have a slot formed in at least one of the reservoir and the outer housing, the projection being disposed in the slot. The slot may extend longitudinally along one of the reservoir and the outer housing and wherein the slot has a second portion which extends generally perpendicular thereto. Additionally, the applicator head may be removably attached to the applicator head cap.

An applicator for applying a fluid to substrate may include a fluid filled reservoir, a top cap attached to the fluid reservoir, the top cap having a valve and a suction tube extending into the fluid reservoir, an outer housing disposed about the fluid reservoir, the outer housing and the fluid filled reservoir selectively interacting the allow the fluid filled reservoir to move in a first direction within the outer housing when the fluid filled reservoir and outer housing are in a first position relative to one another and prevent the fluid filled reservoir to move in the first direction when the fluid filled reservoir and the outer housing are in a second position relative to one another; and an applicator head cap comprising an applicator head being attached to the outer housing and being disposed in engagement with the top cap. The applicator may include a manifold disposed in communication with the applicator head which includes an intake and a plurality of dispensing tubes. At least a portion of the dispensing tubes are disposed in the applicator head. The applicator may have a head cap that has a cavity formed therein for receiving the manifold. The reservoir may have a bottom cap attached thereto. The fluid reservoir may be is threaded and the bottom cap is threadedly attached thereto and the bottom cap may have a projection disposed thereon. The applicator head may be removably attached to the applicator head cap.

The applicator for applying a fluid to a substrate wherein the reservoir contains a known quantity of flowable material and wherein the valve releases a known quantity of the flowable material so as to provide for a predetermined number of doses for the flowable material.

Thus, there is disclosed a new applicator and method of using the same. It will be appreciated that numerous modifications may be made without departing from the scope and spirit of the invention. The appended claims are intended to cover such modifications.

What is claimed is:

1. An applicator having a reservoir, an outer housing disposed about the reservoir, at least one of the outer housing and the reservoir having a projection disposed thereon for selectively engaging the other of the outer housing and reservoir to selectively prevent movement of the reservoir relative to the outer housing in a manner which could cause flowable material to be ejected from the housing, an applicator head and a manifold having an intake disposed in communication with the reservoir for receiving flowable material from the reservoir, and a plurality of dispensing tubes made from a flexible material disposed on an opposing side the manifold from the intake and extending into the applicator head so that the plurality of dispensing tubes deflect as the applicator head is being used.

2. The applicator of claim 1, wherein the fluid reservoir has a floating plunger disposed therein, the floating plunger moving as fluid is dispensed from the fluid reservoir.

3. The applicator of claim 2, further comprising a top cap attached to the fluid reservoir, the top cap containing a valve and a suction tube extending into the fluid reservoir.

4. The applicator of claim 2, further comprising an applicator head cap for holding the applicator head and the outer housing together, the applicator head cap having a cavity for holding the manifold so that the plurality of dispensing tubes extend out of the cavity and into the applicator head.

5. The applicator of claim 4, wherein the outer housing is threadedly attached to applicator head cap.

6. The applicator of claim 4, wherein the intake and the plurality of tubes extending from the manifold are generally parallel to one another.

7. The applicator of claim 4, wherein the applicator head is a brush and wherein the plurality of dispensing tubes are sufficiently flexible to bend as the applicator head bends.

8. The applicator of claim 1, further comprising a bottom cap attached to the reservoir.

9. The applicator of claim 8, wherein the bottom cap is removably attached to the reservoir.

10. The applicator of claim 1 further comprising a slot formed in at least one of the reservoir and the outer housing, the projection being disposed in the slot.

11. The applicator of claim 10, wherein the slot has a first portion which extends longitudinally along one of the reservoir and the outer housing and wherein the slot has a second portion which extends generally perpendicular thereto.

12. The applicator of claim 1, wherein the applicator head is removably attached to the applicator head cap.

13. An applicator for applying a fluid to a substrate, the applicator comprising:

a fluid filled reservoir;

a top cap attached to the fluid reservoir, the top cap having a valve and a suction tube extending into the fluid reservoir;

an outer housing disposed about the fluid reservoir, the outer housing and the fluid filled reservoir selectively interacting the allow the fluid filled reservoir to move in a first direction within the outer housing when the fluid filled reservoir and outer housing are in a first position relative to one another and prevent the fluid filled reservoir to move in the first direction when the fluid filled reservoir and the outer housing are in a second position relative to one another; and an applicator head cap comprising an applicator head being attached to the outer housing and being disposed in engagement with the top cap, and wherein the applicator head cap comprises a cavity with a manifold being disposed in the cavity and an applicator head partly disposed in the cavity above the manifold, wherein the manifold has a plurality of flexible dispensing tubes spaced apart from one another and extending into the applicator head so that the dispensing tubes may deflect as the applicator head is being used.

14. The applicator for applying a fluid to a substrate of claim 13, wherein the applicator head comprises a brush with a plurality of bristles and wherein each of the plurality of dispensing tubes extend into the bristles of the brush.

15. The applicator for applying a fluid to a substrate of claim 14, wherein the applicator head includes a plurality of openings for releasing a flowable material.

16. The applicator for applying a fluid to a substrate of claim 14, wherein the applicator head cap has a cavity formed therein for receiving the manifold, and wherein the manifold has an intake and wherein the manifold and the intake are removably disposed in the cavity.

17. The applicator for applying a fluid to a substrate of claim 14, wherein the fluid reservoir has a bottom cap attached thereto.

18. The applicator for applying a fluid to a substrate of claim 14, wherein the fluid reservoir is threaded and the bottom cap is threadedly attached thereto.

19. The applicator for applying a fluid to a substrate of claim 18, wherein the bottom cap has a projection disposed thereon.

20. The applicator for applying a fluid to a substrate of claim 13, wherein the applicator head is removably attached to the applicator head cap and wherein the manifold has a plurality of dispensing tubes formed thereon and wherein the plurality of dispensing tubes extend into the applicator head when the applicator head is attached to the applicator head cap.

21. An applicator for applying a fluid to a substrate, the applicator comprising a reservoir for holding a flowable material, an applicator head cap disposed in communication with the reservoir, a cavity formed in the head cap and an elliptical manifold body having an intake on one side and a plurality of dispensing tubes extending from an opposing side, the intake and the plurality of dispensing tubes being disposed generally parallel to one another, a removable applicator head and wherein the plurality of dispensing tubes extend into the applicator head when the applicator head is disposed on top of the manifold, and wherein the applicator head comprises a plurality of bristles.

* * * * *